US011843928B2

(12) United States Patent
Chiu

(10) Patent No.: US 11,843,928 B2
(45) Date of Patent: Dec. 12, 2023

(54) ACOUSTIC BLOCK MANUFACTURING METHOD AND ACOUSTIC DEVICE

(71) Applicant: LUXSHARE-ICT CO., LTD., Taipei (TW)

(72) Inventor: Yu-Wei Chiu, Taipei (TW)

(73) Assignee: LUXSHARE-ICT CO., LTD., Taipei (TW)

( * ) Notice: Subject to any disclaimer, the term of this patent is extended or adjusted under 35 U.S.C. 154(b) by 410 days.

(21) Appl. No.: 17/153,617

(22) Filed: Jan. 20, 2021

(65) Prior Publication Data

US 2021/0144502 A1 May 13, 2021

(30) Foreign Application Priority Data

Jul. 22, 2020 (TW) ..... 109124849

(51) Int. Cl.
*H04R 31/00* (2006.01)
*G10K 11/162* (2006.01)
*H04R 1/28* (2006.01)

(52) U.S. Cl.
CPC ..... *H04R 31/003* (2013.01); *G10K 11/162* (2013.01); *H04R 1/288* (2013.01); *H04R 2400/11* (2013.01)

(58) Field of Classification Search
CPC .. G10K 11/162; H04R 2400/11; H04R 1/288; H04R 31/003
See application file for complete search history.

(56) References Cited

U.S. PATENT DOCUMENTS 4,657,108 A * 4/1987 Ward ..... H04R 1/2803 181/149
7,448,467 B2 * 11/2008 Wright ..... H04R 1/2803 381/345
7,743,880 B2 * 6/2010 Matsumura ..... E01F 8/0011 181/294
7,953,240 B2 * 5/2011 Matsumura ..... H04R 1/2803 381/337
7,974,423 B2 * 7/2011 Matsumura ..... H04R 1/2803 181/149
8,565,463 B2 * 10/2013 Saiki ..... H04R 1/2811 381/345
8,794,373 B1 * 8/2014 Lin ..... H04R 1/288 381/345

(Continued)

FOREIGN PATENT DOCUMENTS

CN 101293783 A 10/2008
CN 104994461 A 10/2015

(Continued)

*Primary Examiner* — Forrest M Phillips
(74) *Attorney, Agent, or Firm* — Birch, Stewart, Kolasch & Birch, LLP

(57) ABSTRACT

An acoustic block manufacturing method includes: mixing zeolite powder with water to form a mixed liquid; making the mixed liquid into an ice cube; providing a vacuum environment to make the ice cube undergo gas phase sublimation; and feeding parylene into the vacuum environment in a manner of chemical vapor deposition to form an acoustic block having a porous structure. The acoustic block can effectively reduce resonance frequency. An acoustic device with acoustic blocks is also provided and has the same effect.

9 Claims, 5 Drawing Sheets

(56) References Cited

U.S. PATENT DOCUMENTS

| | | | | |
|---|---|---|---|---|
| 8,991,549 | B2 * | 3/2015 | Lin | B01D 53/0407 381/345 |
| 10,287,451 | B2 * | 5/2019 | Tai | C03C 17/328 |
| 2007/0165895 | A1 * | 7/2007 | Matsumura | H04R 1/2803 381/345 |
| 2012/0027243 | A1 * | 2/2012 | Imamura | H04R 1/2803 381/389 |
| 2013/0308812 | A1 * | 11/2013 | Shen | H04R 1/288 381/346 |
| 2014/0037119 | A1 * | 2/2014 | Yuasa | H04R 1/28 381/346 |
| 2014/0311820 | A1 * | 10/2014 | Lin | B01D 53/0407 181/199 |
| 2015/0290834 | A1 * | 10/2015 | Klotz | C04B 35/053 429/491 |
| 2020/0152165 | A1 | 5/2020 | Gavryushin et al. | |

FOREIGN PATENT DOCUMENTS

| | | | |
|---|---|---|---|
| CN | 106937215 | A | 7/2017 |
| CN | 107116857 | A | 9/2017 |
| CN | 105237033 | A | 1/2018 |
| CN | 108136283 | A | 6/2018 |
| CN | 108314779 | A | 7/2018 |
| CN | 108566598 | A | 9/2018 |
| CN | 108751222 | A | 11/2018 |

* cited by examiner

ACOUSTIC BLOCK MANUFACTURING METHOD AND ACOUSTIC DEVICE

CROSS-REFERENCE TO RELATED APPLICATION

This non-provisional application claims priority under 35 U.S.C. § 119(a) to Patent Application No. 109124849 filed in Taiwan, R.O.C. on Jul. 22, 2020, the entire contents of which are hereby incorporated by reference.

BACKGROUND

Technical Field

The present invention relates to an acoustic block manufacturing method, and in particular, to a manufactured acoustic block having a porous structure, which can be applied to the field of acoustics.

Related Art

With the improvement in the living standard, people pay increasing attention to the quality of speakers, such as a visual effect in appearance and a representation of the sound quality. For a mobile electronic device, a speaker of which has a relatively small size, and a representation at low frequency is limited.

Conventionally, a cavity body of an acoustic device is filled with zeolite powder to improve the representation of the speaker at low frequency. However, the used zeolite powder contains an aluminum element that can block microporous passages of the zeolite powder, which is adverse to air entry. Consequently, an acoustic effect is reduced.

Therefore, how to alleviate the problem is an extremely important subject for persons skilled in the art.

SUMMARY

In view of this, the present invention provides an acoustic block manufacturing method in an embodiment, including: mixing zeolite powder with water to form a mixed liquid; making the mixed liquid into an ice cube; providing a vacuum environment to make the ice cube undergo gas phase sublimation; and feeding parylene into the vacuum environment in a manner of chemical vapor deposition to form an acoustic block having a porous structure.

As the above acoustic block manufacturing method in an embodiment, a particle size of the zeolite powder ranges from 0.1 μm to 5 μm.

The above acoustic block manufacturing method in an embodiment further includes adding a structural strengthening agent to the mixed liquid.

As the above acoustic block manufacturing method in an embodiment, a weight concentration of the zeolite powder in the mixed liquid ranges from 1% to 40%.

As the above acoustic block manufacturing method in an embodiment, the zeolite powder excludes an aluminum element.

The above acoustic block manufacturing method in an embodiment further includes adding an elastic material to the mixed liquid.

The present invention further provides an acoustic device including a cavity body and a speaker. The cavity body is filled with the above acoustic block. The speaker is disposed in the cavity body.

The above acoustic device in an embodiment further includes a mesh layer disposed in the cavity body and located between the speaker and the acoustic block.

As the above acoustic device in an embodiment, a pore size of each mesh pore is greater than 25 μm.

In the acoustic block manufacturing method according to at least one embodiment of the present invention, manufacturing costs are low and it is easy to control a shape of the acoustic block. The manufactured acoustic block has a porous structure, which is conducive to air circulation and sound conduction. The acoustic block is applied to the acoustic device, which has a good acoustic representation and can effectively reduce resonance frequency. Moreover, an embodiment of the present invention further provides the acoustic device. The acoustic device has the above acoustic block, so that the structure of the acoustic block can slow a gas flow speed, equivalently enlarge the cavity body and reduce the resonance frequency, thereby having a relatively good acoustic effect at low frequency.

DETAILED DESCRIPTION

Figure 1:
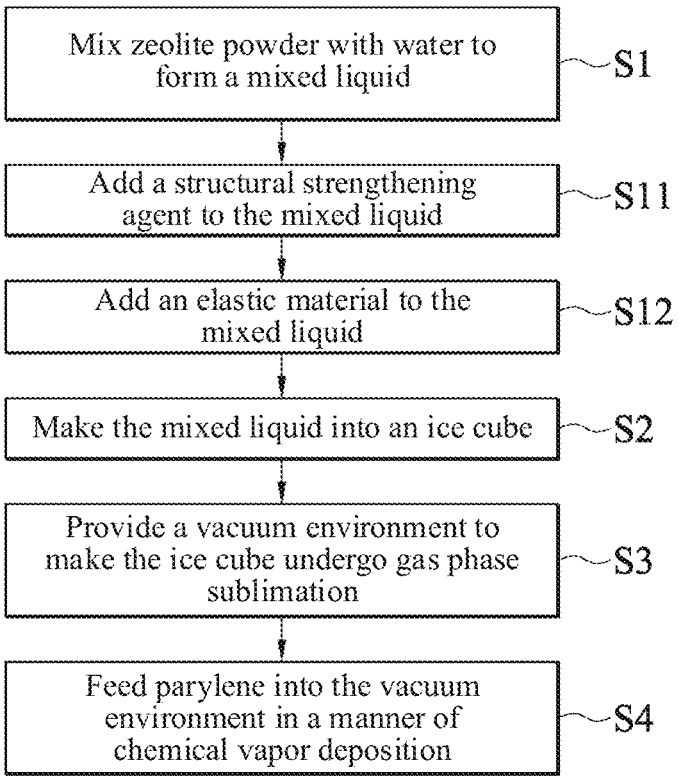
FIG. 1 is a schematic flowchart of steps of an embodiment of an acoustic block manufacturing method according to the present invention.

FIG. 1 is a schematic flowchart of steps of an embodiment of an acoustic block manufacturing method according to the present invention. The steps include: S1: Mix zeolite powder with water to form a mixed liquid, so that the zeolite powder is evenly dispersed in the mixed liquid. S2: Make the mixed liquid into an ice cube. A form of the ice cube can control a shape of the manufactured acoustic block. The acoustic block is disposed in an acoustic device to save forming costs. S3: Provide a vacuum environment to make the ice cube undergo gas phase sublimation. S4: Feed parylene into the vacuum environment in a manner of chemical vapor deposition (CVD) to replace the water and/or ice pellets with parylene, to form an acoustic block having a porous structure.

Figure 2A:
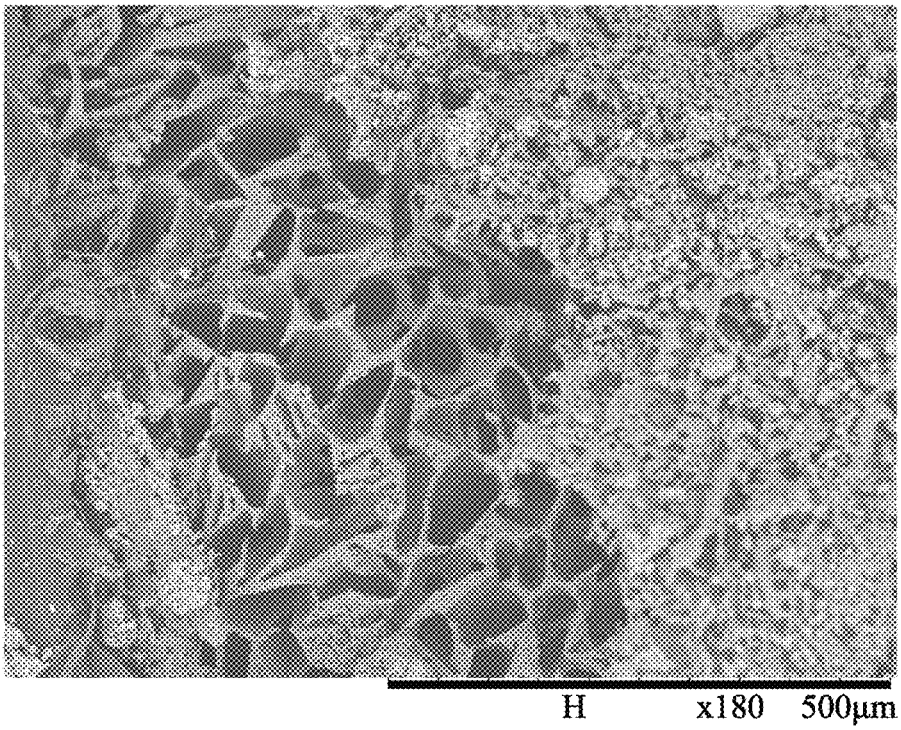
FIG. 2A to FIG. 2D are images of an embodiment of an acoustic block according to the present invention at different magnifications of an electron microscope.
Figure 2B:
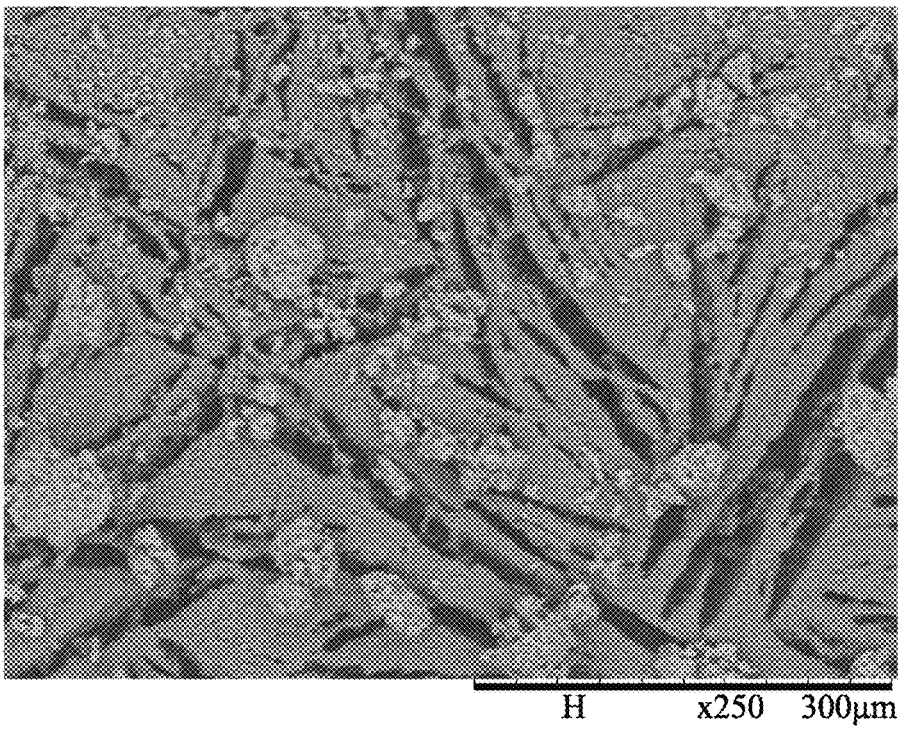
Figure 2C:
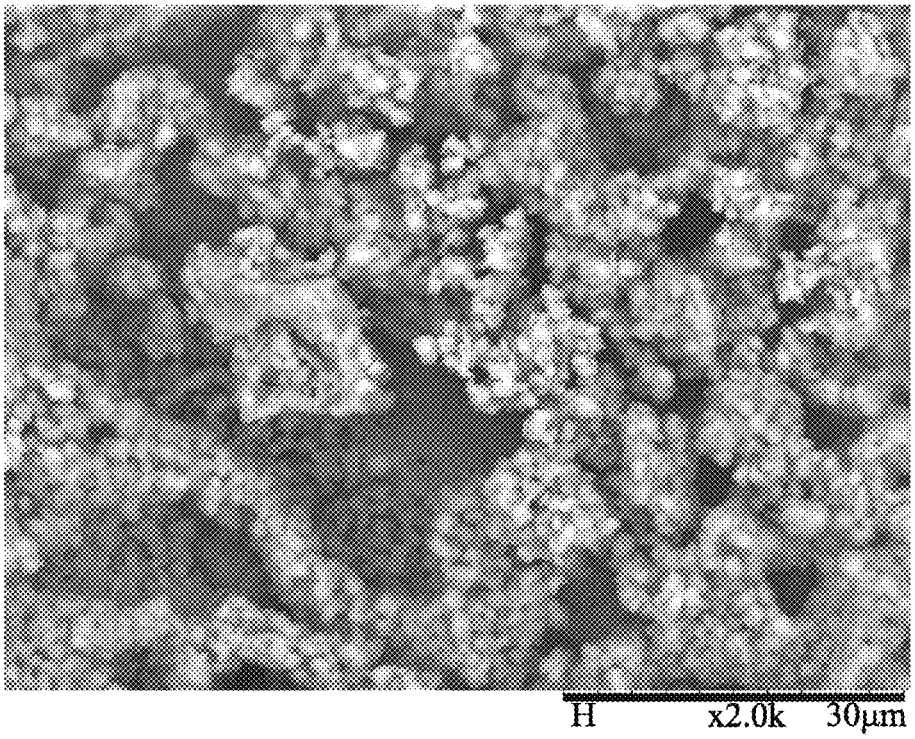
Figure 2D:
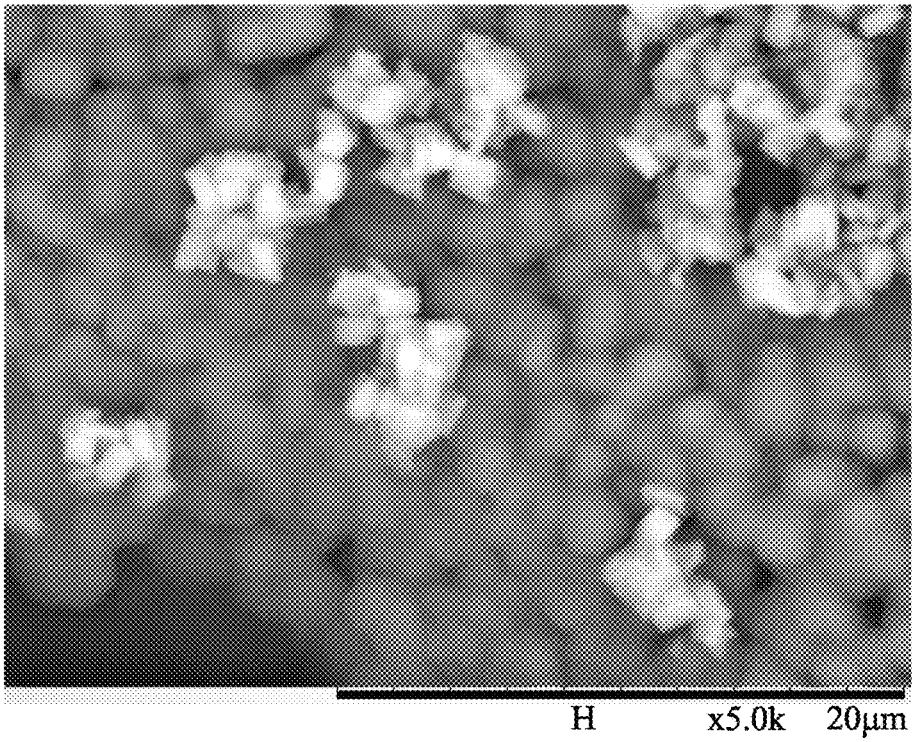

FIG. 2A to FIG. 2D are images of an embodiment of an acoustic block according to the present invention in an electron microscope. FIG. 2A is an image at a magnification of 180, FIG. 2B is an image of at a magnification of 250, FIG. 2C is an image at a magnification of 500, and FIG. 2D is an image at a magnification of 5000.

Figure 3A:
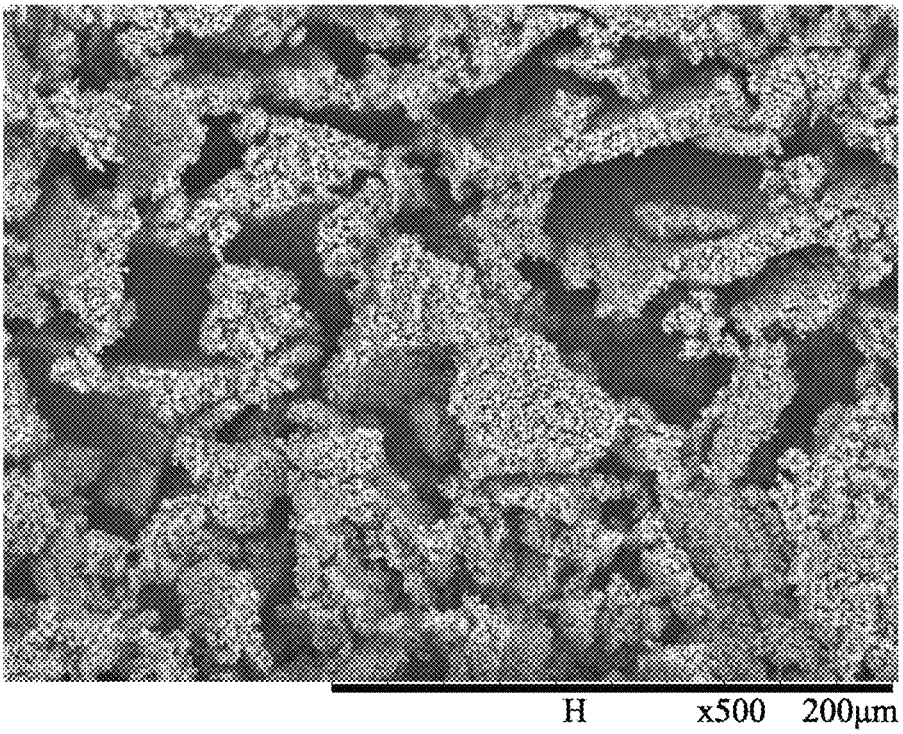
FIG. 3A and FIG. 3B are images of the inside of the acoustic block according to the embodiment shown in FIG. 2A at different magnifications of an electron microscope.
Figure 3B:
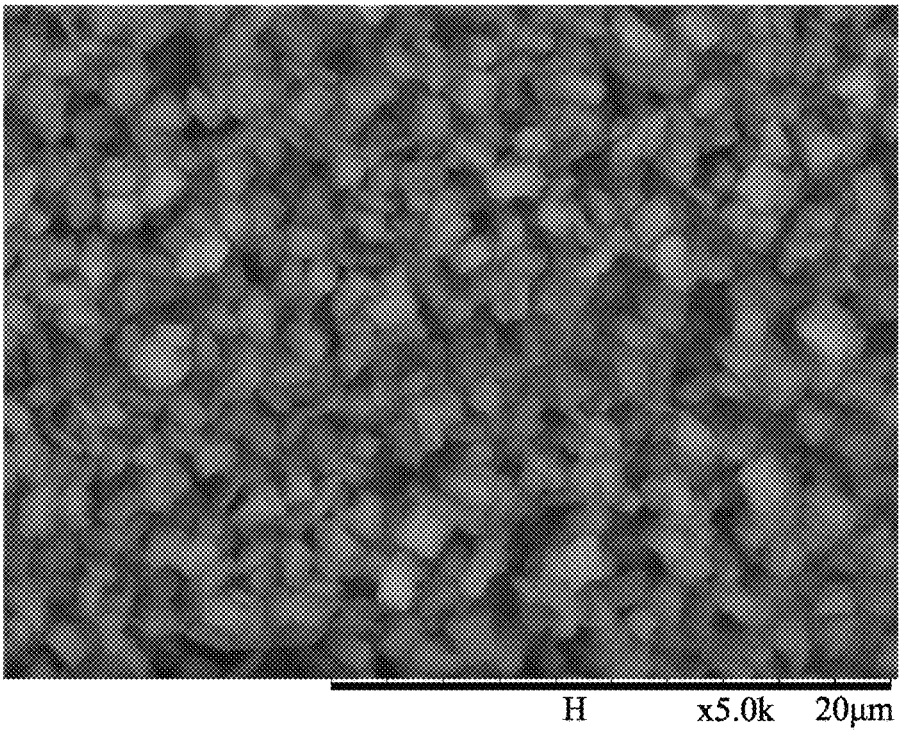

FIG. 3A and FIG. 3B are images of the inside of the acoustic block according to the embodiment shown in FIG. 2A in an electron microscope. FIG. 3A is an image at a magnification of 500, and FIG. 3B is an image at a magnification of 5000.

It may be learned from FIG. 2A to FIG. 3B that the acoustic block has a structure with a plurality of pores that are conducive to air circulation. In some embodiments, a particle size of the zeolite powder ranges from 0.1 μm to 5 μm. Preferably, a particle size of the zeolite powder is 2 μm. The acoustic block is disposed in a cavity body with a diameter of 15 mm and a height of 2 mm, which reduces resonance frequency of 100 Hz.

Referring to FIG. 1 again, in this embodiment, the acoustic block manufacturing method further includes step S11: Add a structural strengthening agent to the mixed liquid. The structural strengthening agent is an adhesive. Adding the structural strengthening agent is to bond particles of the zeolite powder together in a manufacturing process, which is further conducive to forming the acoustic block having the porous structure. In some embodiments, the used structural strengthening agent is cellulose nanofiber (CNF). In some other embodiments, the used structural strengthening agent is carboxymethyl cellulose (CMC). However, the present invention is not limited to the embodiments.

In some embodiments, a weight concentration of the zeolite powder in the mixed liquid ranges from 1% to 40%. In the foregoing weight concentration range, the higher the weight concentration of the zeolite powder is, the better the effect of reducing resonance frequency of the manufactured acoustic block used in the acoustic device is. Particle (as shown in FIG. 2A to FIG. 3B) sizes of acoustic blocks manufactured by zeolite powder with different weight concentrations are different. For the effect of reducing resonance frequency, large particles are better than small particles, and manufacturing costs of the acoustic block having large particles are lower.

Moreover, there are zeolite powder containing an aluminum element and zeolite powder not containing an aluminum element. In an embodiment, the zeolite powder containing an aluminum element may be, for example, MFI-type ZSM-5 zeolite powder, and the zeolite powder not containing an aluminum element may be MFI-type Silicalite-1 zeolite powder. In an embodiment, if the weight concentrations of the zeolite powder are the same, the effect of reducing resonance frequency by using the acoustic block manufactured by the zeolite powder not containing an aluminum element is better than that by using the acoustic block manufactured by the zeolite powder containing an aluminum element. A reason is that silicon in the zeolite powder is positive tetravalence and aluminum in the zeolite powder is positive trivalence. As a result, aluminum-contained ions in the zeolite powder need to be balanced by using other positive ions. However, positions occupied by the positive ions can block microporous passages in the zeolite powder, which obstructs air flow. Consequently, an acoustic effect is affected.

Referring to FIG. 1 again, the above acoustic block manufacturing method in an embodiment further includes step S12: Add an elastic material to the mixed liquid. Adding the elastic material is to improve the entire strength of the acoustic block, so that it is not easy to shatter the acoustic block when applied to the acoustic device.

Figure 4:
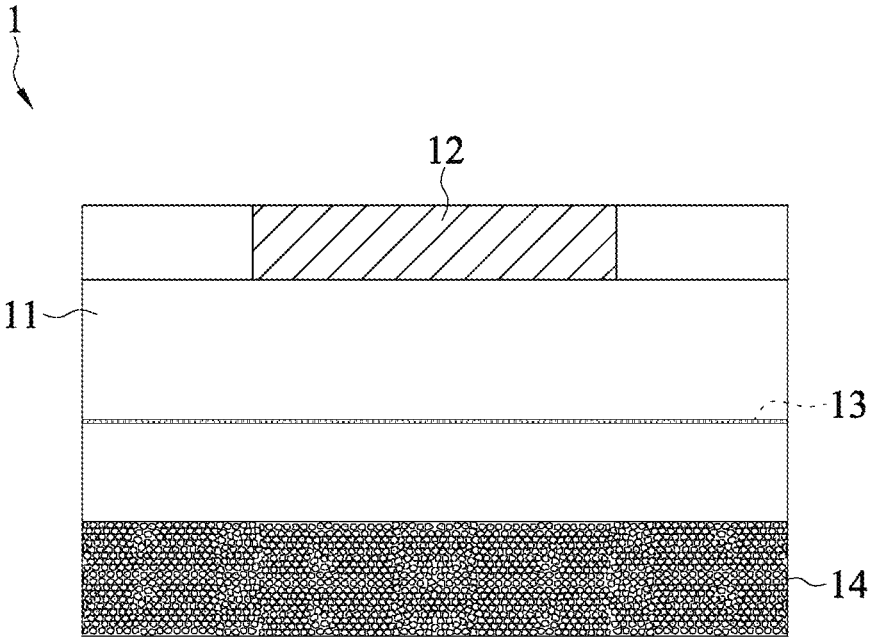
FIG. 4 is a schematic diagram of an embodiment of an acoustic device according to the present invention.

FIG. 4 is a schematic diagram of an embodiment of an acoustic device 1 according to the present invention. The acoustic device 1 includes a cavity body 11 and a speaker 12. The cavity body 11 is filled with an acoustic block 14 having a porous structure.

The speaker 12 is disposed in the cavity body 11.

Moreover, in this embodiment, the acoustic device 1 further includes a mesh layer 13. The mesh layer 13 is disposed in the cavity body 11 and located between the speaker 12 and the acoustic block 14. The mesh layer 13 can protect the acoustic block 14. In some embodiments, a pore size of each mesh pore in the disposed mesh layer 13 is greater than 25 μm.

In the acoustic block manufacturing method according to at least one embodiment of the present invention, manufacturing costs are low and it is easy to control a shape of the acoustic block to fit a suitable device (cavity body). The acoustic block has a porous structure, which is conducive to air circulation. The acoustic block is applied to the acoustic device, which has a good acoustic representation and can effectively reduce resonance frequency, to resolve the problem encountered in the prior art. The present invention further provides an acoustic device according to an embodiment, which has the foregoing acoustic block. The porous structure of the acoustic block slows gas flow, equivalently enlarges the cavity body and reduces the resonance frequency. Therefore, the acoustic device has a better acoustic representation at low frequency.

What is claimed is:

1. An acoustic block manufacturing method, comprising:

mixing zeolite powder with water to form a mixed liquid, wherein the zeolite powder excludes an aluminum element, and a particle size of the zeolite powder ranges from 0.1 μm to 5 μm;

making the mixed liquid into an ice cube;

providing a vacuum environment to make the ice cube undergo gas phase sublimation; and feeding parylene into the vacuum environment in a manner of chemical vapor deposition to form an acoustic block having a porous structure.

2. The acoustic block manufacturing method according to claim 1, further comprising adding a structural strengthening agent to the mixed liquid.

3. The acoustic block manufacturing method according to claim 1, wherein a weight concentration of the zeolite powder in the mixed liquid ranges from 1% to 40%.

4. The acoustic block manufacturing method according to claim 1, further comprising adding an elastic material to the mixed liquid.

5. The acoustic block manufacturing method according to claim 2, further comprising adding an elastic material to the mixed liquid.

6. The acoustic block manufacturing method according to claim 3, further comprising adding an elastic material to the mixed liquid.

7. An acoustic device, comprising:

a cavity body, filled with the acoustic block according to claim 1; and a speaker, disposed in the cavity body.

8. The acoustic device according to claim 7, further comprising a mesh layer disposed in the cavity body and located between the speaker and the acoustic block.

9. The acoustic device according to claim 8, wherein a pore size of each mesh pore in the mesh layer is greater than 25 μm.

* * * * *